US005537089A

United States Patent [19]

Greif et al.

[11] Patent Number: 5,537,089

[45] Date of Patent: Jul. 16, 1996

[54] THREE PHASE TRANSFORMER WITH REDUCED HARMONIC CURRENTS

[75] Inventors: Milton J. Greif, Whitehouse Station, N.J.; Curtis E. Stevens, Irvine, Calif.

[73] Assignee: Parker-Hannifin Corporation, Cleveland, Ohio

[21] Appl. No.: 68,259

[22] Filed: May 27, 1993

[51] Int. Cl.[6] ..... H01F 27/24

[52] U.S. Cl. ..... 336/215; 336/5; 336/12; 336/84 C; 336/184

[58] Field of Search ..... 336/5, 12, 215, 336/84 C, 84 R, 183, 184

[56] References Cited

U.S. PATENT DOCUMENTS 2,401,952 6/1946 Mayberry .
2,458,052 1/1949 Brown .
2,458,112 1/1949 Steinmayer .
5,050,058 9/1991 April et al. ..... 335/5

FOREIGN PATENT DOCUMENTS 1388065 3/1979 United Kingdom .

OTHER PUBLICATIONS

A. C. Franklin, et al., "A Practical Technology of the Power Transformer" . The J & P Transformer Book 11th edition, Butterworths pp. 23–25.

*Primary Examiner*—Laura Thomas
*Attorney, Agent, or Firm*—Rankin, Hill, Lewis & Clark

[57] ABSTRACT

A transformer comprising a core, a plurality of primary coils and a plurality of secondary coils, the core having three sections arranged in a generally triangular configuration forming three vertices, the coils being disposed on the core about respective vertices, each of the core sections having at least one mitered side abutting a mitered side of an adjacent core section.

30 Claims, 6 Drawing Sheets

THREE PHASE TRANSFORMER WITH REDUCED HARMONIC CURRENTS

BACKGROUND OF THE INVENTION

The invention relates generally to multiphase transformers. More particularly, the invention relates to multiphase transformer core and winding designs for reduced harmonic currents in the primary windings.

Transformers are commonly used in many applications for converting AC voltage, from a variable source such as an alternator, to a different AC voltage level, or in combination with a rectifier circuit to DC voltage. For example, in the aerospace industry, aircraft control systems often use electrical servo and tractive motors that require different voltage levels from the source voltage. Many of these uses require transformers to supply voltage to rectifier circuits delivering 90 VDC to 440 VDC.

The primary energy source in such applications is typically an aircraft alternator that produces three phase outputs at an operating frequency in the typical range of 400 to 800 hertz depending on engine speed and loads. These alternators may be used for supplying power to a wide variety of DC circuits and loads. Accordingly, aerospace standards (such as MIL-STD-1399) typically require that there be no harmonic currents drawn from the alternator main power lines which exceed 3% (–30 db) of the rated fundamental current up to the 32nd harmonic. It is expected that these types of limits on harmonic currents drawn from the main supply also will apply in general to European Economic Community members for industrial and consumer AC/DC power conversion equipment starting in 1993.

A typical uncompensated 3 phase full wave bridge or 6 phase half wave bridge AC/DC rectifier generates well above 10% harmonic currents.

Known methods and apparatus for reducing these harmonic currents include a minimum use of 24 rectifiers connected to twelve multiphase secondary windings with the use of additional chokes and interphase transformers being required to meet the 3% harmonic current requirement. Other approaches include power factor correction circuits which use pulse width modulated regulator circuitry to control harmonics. These designs involve complicated and expensive circuits and controls.

The need exists, therefore, for a three phase input transformer design that produces reduced harmonic currents, such as in an AC/DC conversion circuit, in a package that is weight and cost competitive with the aforementioned known systems.

SUMMARY OF THE INVENTION

In response to the aforementioned needs, the present invention provides a 3 phase input transformer comprising a core, a plurality of primary coils and a plurality of secondary coils, the core having three sections arranged in a generally triangular configuration forming three vertices, each primary coil being disposed on the core about one of the vertices, each of the core sections having at least one mitered side abutting a mitered side of an adjacent section.

The invention also contemplates a transformer winding arrangement for a low harmonic transformer connectable to a three phase input comprising three primary coils and nine secondary coils, the secondary coils being arranged in three sets of three coils, each of the three sets being wye connected and electrically isolated from each other.

These and other aspects and advantages of the present invention will be readily understood and appreciated by those skilled in the art from the following detailed description of the preferred embodiments with the best mode contemplated for practicing the invention in view of the accompanying drawings.

DETAILED DESCRIPTION OF THE INVENTION

With reference to FIG. 1, the present invention contemplates a transformer design that achieves a substantial reduction in harmonic currents drawn from a 3 phase input supply such as an alternator driven by an aircraft engine. Although the invention is described herein in an exemplary manner with respect to aerospace applications, such description is only for purposes of convenience and should not be construed in a limiting sense. Those skilled in the art will readily appreciate that the invention can be used in many applications other than for aerospace transformers, such as for example, industrial and commercial power systems. The particular application of a transformer in accordance with the invention is largely a matter of design choice, although the invention is particularly well suited for AC/DC power conversion where low harmonic currents are specified and/or desired.

Figure 1A:
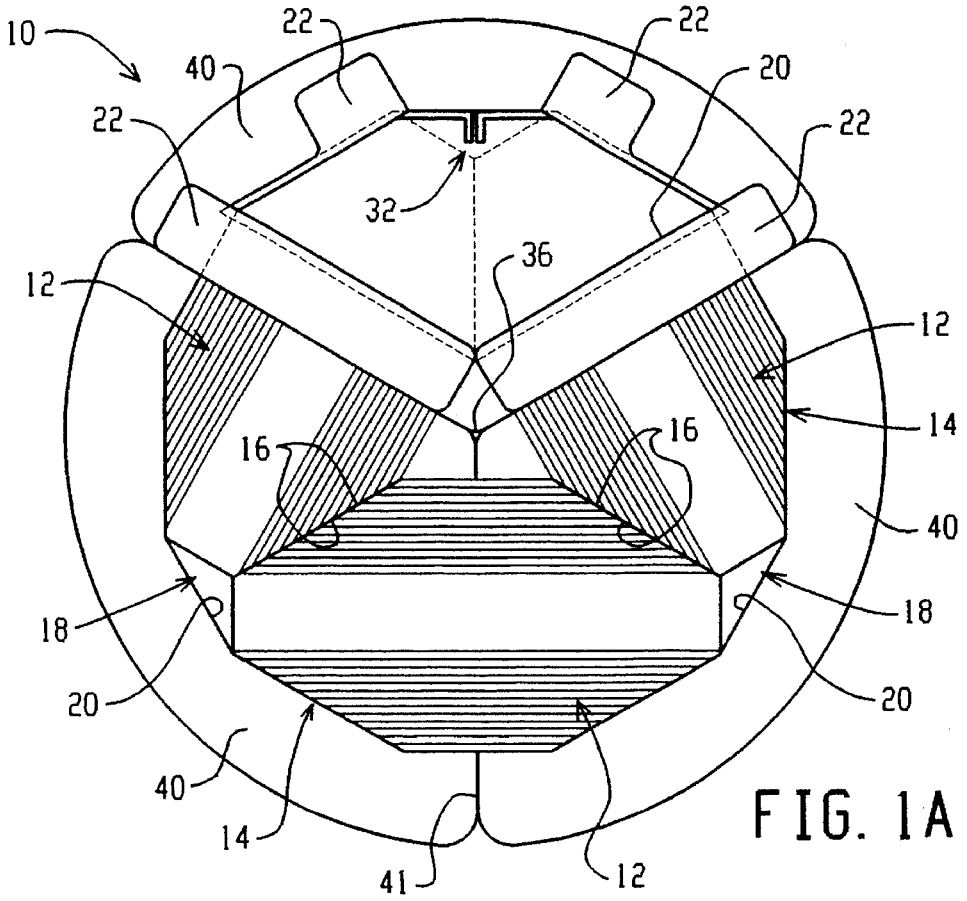
FIG. 1A is a top view of a transformer in multiple partial cross-sections having a core according to the present invention with a portion of core sections at a vertex omitted to show flange members of a bobbin.
Figure 1B:
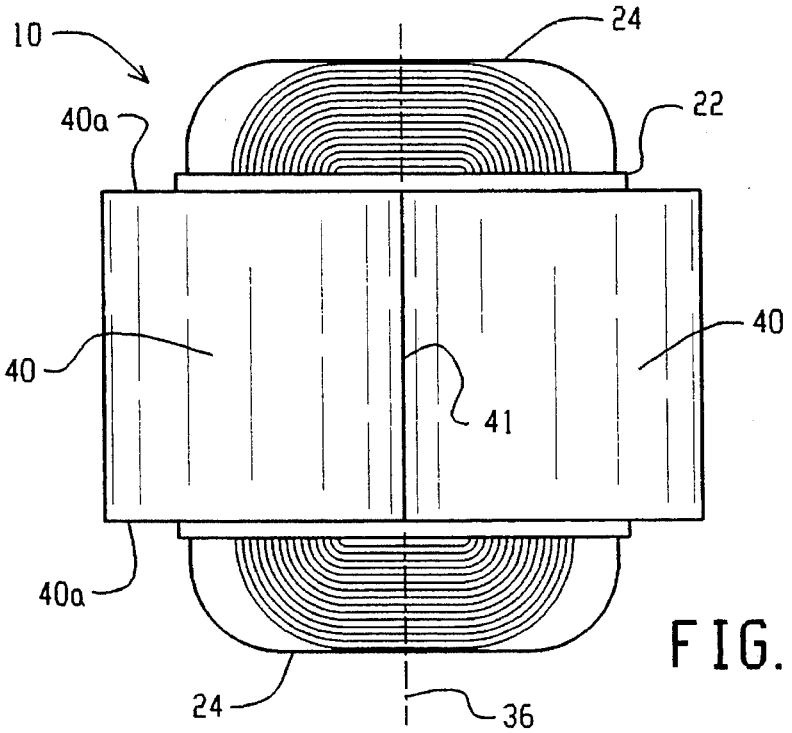
FIG. 1B is a side view thereof.

As illustrated in FIG. 1A, the transformer 10 includes three core assemblies 12 arranged in a generally triangular configuration. In FIG. 1A, various portions of the transformer have been shown in section for clarity and understanding. Each core assembly has beveled sides 14, preferably cut at 60 degree angles to form miter edges 16 that can be closely joined at three vertices 18. The transformer further includes three bobbin assemblies 20, each bobbin being disposed about a respective core vertex 18. A plurality of coils 40 are wound on each bobbin assembly about each respective vertex. At areas where adjacent coils are in close relationship, such as at 41, a layer of insulative material is provided to prevent electrical short circuits. Each bobbin assembly 20 may include one or more bobbin flanges 22 that fold over portions of the coil 40 ends for cooling. As better shown in FIG. 1B, the coils 40 substantially enclose the core legs, with the core ends 24 extending above and below the coils ends 40*a*.

The cores 12 are preferably formed from standard cut-C core stock. Such cores are typically laminated structures using electrical grain oriented steel or other magnetic material. For example, the laminations may be made from 0.004 in. thick ribbon of electrical iron, this being but one of many examples of a suitable core material. A standard cut-C core has square or rectangular legs connected by a rectangular end. In accordance with the present invention, such a standard core is modified by cutting the sides by any convenient cutting means (such as, for example, grinding or laser cutting to name just two of many examples) to form the beveled or mitered edges 16.

The bobbins 20 include a plurality of coils and windings 40 for the primary and secondary coils As used herein, the term "coil" means any winding or plurality of windings formed by a plurality of full turns and half turns of wire to produce a two terminal secondary output. The term "winding" refers to full turns and half turns of wires used to form either separate windings within a coil, or auxiliary windings. However, these terms are not to be construed in a limiting sense. Whether a particular group of wire turns is referred to as a winding or coil is primarily intended to simply distinguish the particular structures being described from each other for clarity and convenience and has no functional significance with respect to operation of the transformer.

Preferably, the primary and secondary coils and windings are wound on their respective bobbins and then the cores are inserted into the bobbins and clamped together such as with a steel banding strap or other convenient means to minimize the air gap between the core halves thereby reducing magnetizing currents and transformer noise. Alternatively, the primary and secondary coils and windings can be formed on a mandrel without the use of the bobbins in the transformer. The bobbins are preferred for ease of assembly, improved heat dissipation and electromagnetic shielding, however, the bobbins are not required for all transformer applications.

Figure 2B:
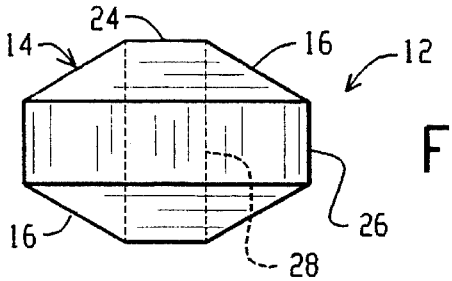
FIG. 2B is a top view thereof.
Figure 2A:
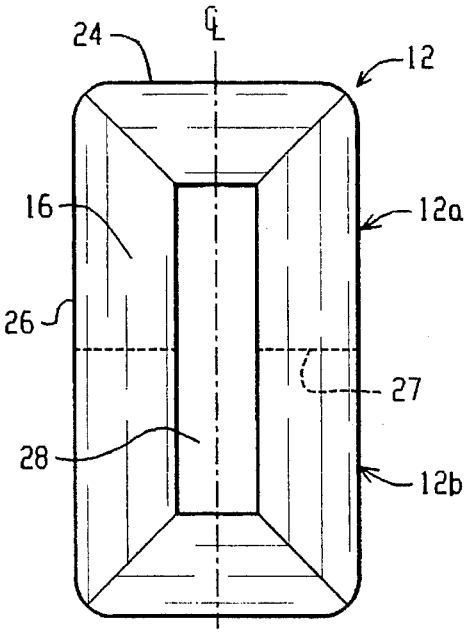
FIG. 2A is a elevation of a core assembly prior to separation into two core halves.
Figure 2C:
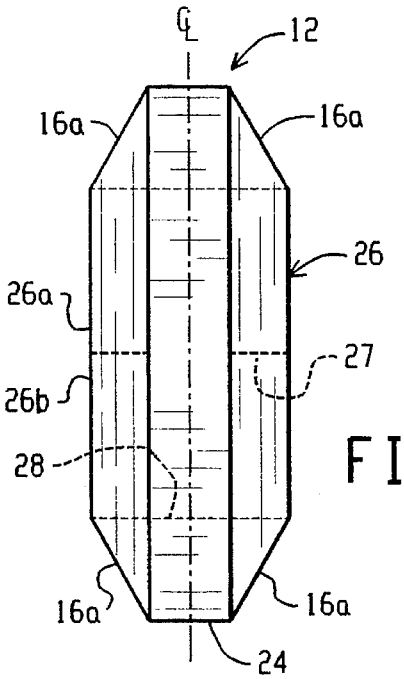
FIG. 2C is a side view thereof.

With reference next to FIGS. 2A–2C, we show a cut-C core assembly 12 that has been formed with the beveled contour but not cut into the complementary core halves. In actual practice, however, the core will be cut in the usual manner into two halves before the bevelling operation is performed, although this exact processing order is not absolutely required. As noted, the core 12 is formed from a standard C core stock which is a laminated structure comprising two generally parallel legs 26 joined at opposite ends by the core end pieces 24 to define a central opening 28. The basic rectangular stock core is machined or otherwise shaped to the desired configuration wherein preferably the leg sides are beveled as at 16. The beveled sides permit a more complete fill of the bobbins with the laminations to improve efficiency and reduce copper losses. This arises from the fact that the bobbins can be faired around the beveled corners with reduced air gaps compared to a conventional C core having 90 degree cornered sides.

In the embodiment of FIGS. 2A–2C, the cores are double cut on each side thereof to form trapezoidal shaped core contours. Before the laminated core 12 is beveled to the desired contour, the core is bisected or cut in half generally through the midpoint of the legs 26 in a conventional manner to provide two substantially identical core halves 12*a* and 12*b* along a cut line 27. This permits the respective core halves to be slip fit into the wound bobbins from either side thereof (see FIG. 1B.) Thus, a complete 3 phase transformer 10 actually comprises six core halves. After assembly into the bobbins 20 and coils 40, the associated core pairs can be clamped together using banding strap or other convenient means to maintain a tight gap between the abutting core leg ends, as is well known to those skilled in the art. It will be noted in FIG. 2C that the core assembly 12 ends 24 are also shown as bevelled between the ends and the legs as at 16*a*. These bevels are optional and do not present the direct interface between adjacent core sections at each vertex but will reduce weight.

A particular advantage of the triangular C core arrangement is that it provides for the convenient incorporation of half turns in the secondary windings. These half turns simplify the secondary winding assembly to achieve the desired turns ratio so that the secondary winding voltages are properly balanced and of the correct phase angle.

The double cut C core assemblies 12, when assembled and closely joined for minimal air gaps, also result in balanced currents in each of the primary windings, unlike a conventional 3 phase input cut-C transformer. The transformer assembly 10 can also be fit into a cylindrical housing that can easily be sealed.

Figure 3B:
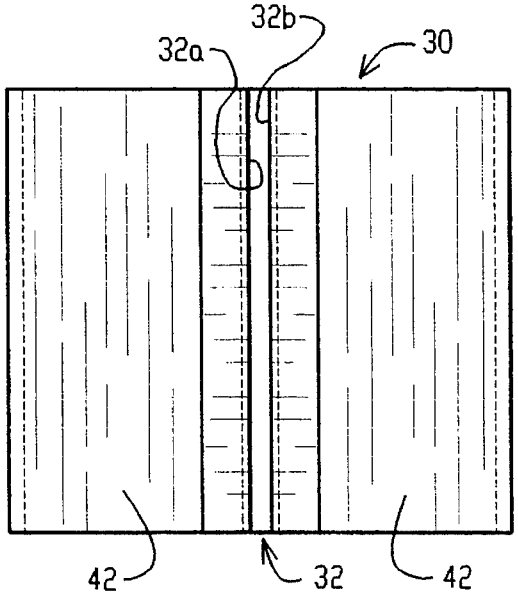
FIG. 3B is a side view thereof.
Figure 3A:
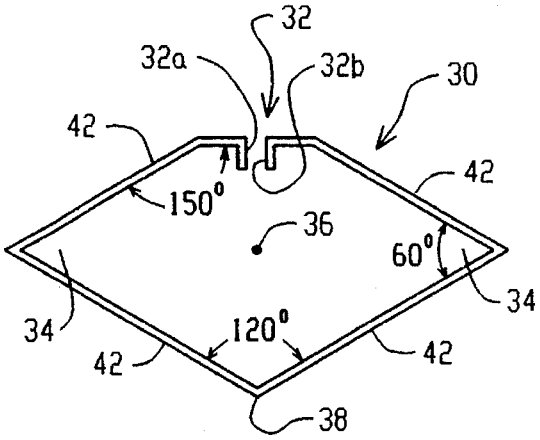
FIG. 3A is a top view of a bobbin according to the invention.

Referring next to FIGS. 3A and 3B, each bobbin assembly 20 preferably includes a five sided aluminum tube 30 that includes at least one completely lengthwise split 32. The tube 30 defines the core fill areas 34 where miter-fit core legs from adjacent core assemblies 12 are inserted into the bobbins after the windings are wound thereon. The bobbin splits 32 are preferably located (see FIG. 1A with only one split 32 shown for clarity) on radial lines from the transformer 10 core central axis 36 (which extends perpendicular to the plane of the drawing of FIG. 1A). Assembly can be further facilitated by forming each bobbin assembly from two mirror halves and then joining the halves at the inner vertex 38 or outer vertex 18. Each split 32 should be insulated to prevent the surfaces 32*a* and 32*b* from touching thereby producing an undesirable short circuit about the cores. The bobbin assembly preferably includes additional flanges 22*a* integrally formed on the bobbin tube 30 (in FIG. 1A the upper and lower flanges 22*a* have been partly left off in order to show the coil assemblies thereunder). The flanges also provide attachment surfaces for shields connected to the bobbins on the outside of the coils. The flanges simplify the winding process by confining the windings in proper alignment until potting material or other sealant can be applied to secure the windings in place. The flanges also help with cooling the transformer and completing the shielding around the coils. The outside surface 42 of the bobbin tube 30 is insulated such as by kapton™ tape, a polyimide material, epoxy paint or other convenient means to prevent electrical shorts from the windings on the bobbin to the bobbin and/or the core. After the primary and secondary coils and windings are wound onto the bobbin, an outer bobbin shield (not shown) may be placed thereover in a conventional manner for shielding and protecting the windings.

Although each bobbin 20 is shown as having a preferably five sided contour, the bobbin contour is primarily determined by the final shape of the core. Thus, the bobbin could also be a simple four sided contour, particularly when the core assemblies are shaped to form substantially triangular vertices rather than a trapezoidal contour.

In accordance with an important aspect of the invention, the primary and secondary coils and windings are wound on the bobbins in a preferred manner to substantially reduce the harmonic currents and to improve the mutual coupling and achieve the desired voltages and phases across the various secondary outputs. This aspect of the invention relates to the physical arrangement of the coils and windings on the bobbins, as well as the electrical interconnection of the windings to achieve the desired low harmonic primary currents. The improvements and advantages of the secondary winding techniques according to the invention can improve performance of transformers, even if the mitered triangular core arrangement is not used. The mitered triangular core, however, is preferred for three phase input low harmonic transformers.

Figure 4:
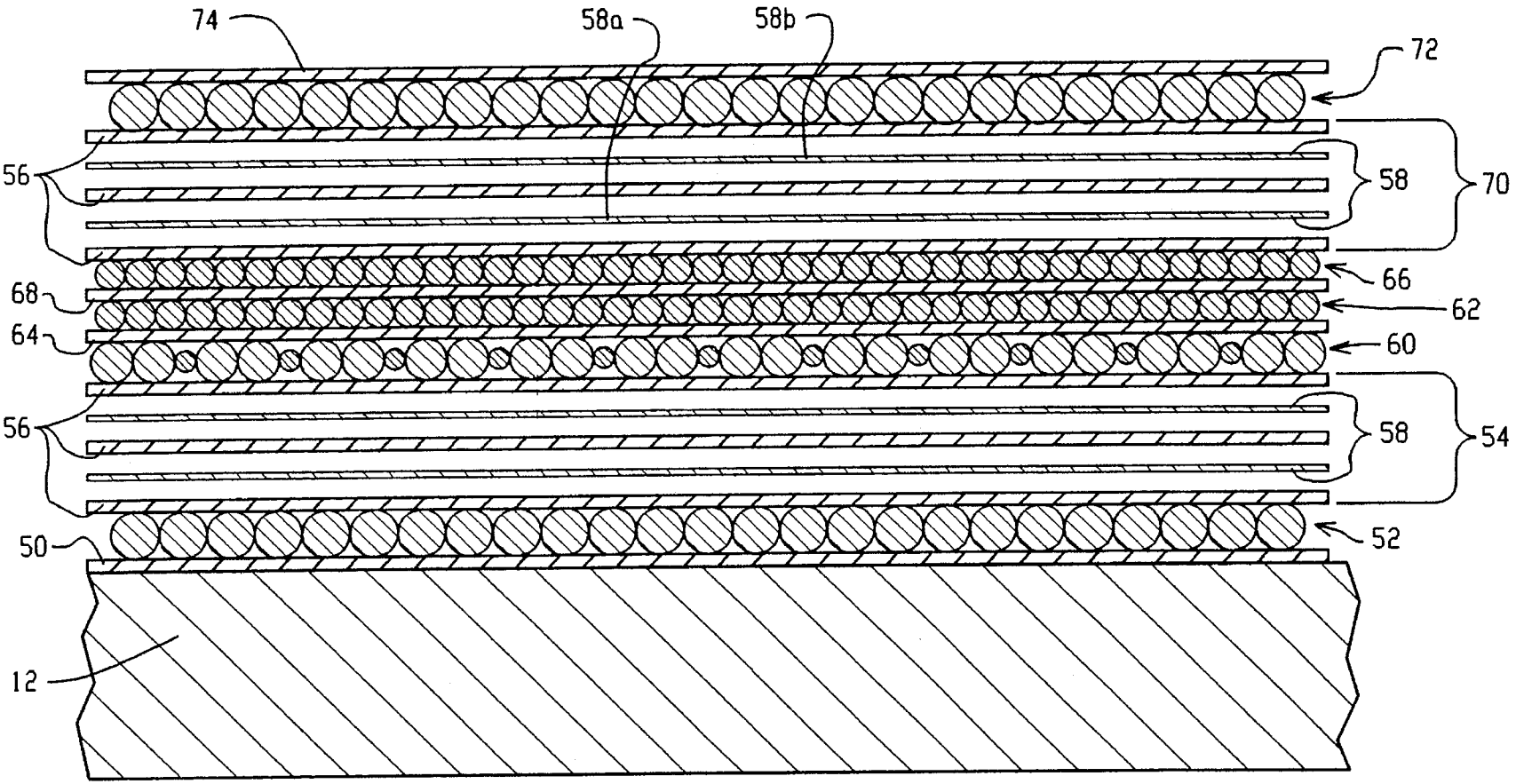
FIG. 4 is a representative cross-sectional view of a bobbin core with the windings and shields installed thereon.

With reference to FIG. 4, the various windings and coils are disposed about each respective bobbin assembly 20 such that the secondary windings are sandwiched between two primary windings that are electrically connected together to provide a primary main coil. This configuration substantially improves the coupling between the primary coils and the associated secondary windings.

According to this aspect of the invention, the bobbin tube 20 inner wall 50 closely abuts the associated core 12 (after assembly of the core into the bobbin assemblies.) First, an inner primary winding 52 is wound onto the bobbin 20. Next, a shield 54 is wrapped around the inner primary winding 52. As shown in FIG. 4, the shield 54 includes alternating layers of insulator material 56 and copper lamination layers 58. Preferably, the shield includes two copper layers alternately interposed between three insulative layers (In FIG. 4, the shields are shown in an expanded view for clarity and understanding. In actual practice the copper layers and insulator layers 58, 56 are sandwiched together, such as for example, using multiple copper laminated sheets of Kapton®layers.) The inner copper layer **58*a* is used as a primary winding shield, and the outer copper layer 58*b*** is also used as a primary winding shield to prevent noise coupling from the secondaries to the primaries.

After the first or inner shield 54 is in place, the secondary windings 60 are wound onto the bobbin 20. As will be explained hereinafter, in accordance with the invention the secondary windings include secondary mains, secondary main legs and secondary auxiliary legs. Preferably, the secondary mains 60 are first wound on the bobbin 20 over the first shield 54. A first insulative layer 64 is then wrapped around the secondary mains. Next, the secondary main leg windings 62 are wound over the first insulating layer 64. A second insulating layer 68 is wound over the main legs 62, and then the secondary auxiliary leg windings 66 are installed over the second insulating layer 68. After the secondary windings are thus disposed on the bobbin 20, a second or outer shield 70 is disposed around the secondary windings. The second shield 70 is substantially the same as the first shield 54. Finally, an outer primary winding 72 is wound onto the bobbin 20. This outer primary is electrically connected to the inner primary 52 so that the secondary windings are effectively sandwiched between the primary windings for optimum coupling therebetween. The primary windings 53,72 can be electrically connected in series or parallel, depending on which arrangement gives the optimum coupling for the particular transformer being designed. When series connected, the wire size for the primary typically will be larger (for example #14 AWG) than when the windings are connected in parallel (for example using #17 AWG.) A final insulating layer 74 may be provided over the entire bobbin assembly 20.

The specific way that the various secondary windings are positioned between the primaries, as well as the wire gauges, will also depend on the transformer specification and also can be used to adjust carefully the secondary outputs to achieve the correct voltages and phase relationships. This is because the actual physical position of the various coils used, as well as the coil wire sizes, will be selected as a function of the type of core used, the degree of coupling achieved using various coil positions, the harmonic currents specified, and so on.

In accordance with another important aspect of the invention, the secondary windings are electrically connected in such as manner as to reduce substantially the harmonic currents. In most applications, the primaries are preferably delta connected for reduced third harmonics, although wye connections can be used when needed for a specific application.

Figure 5:
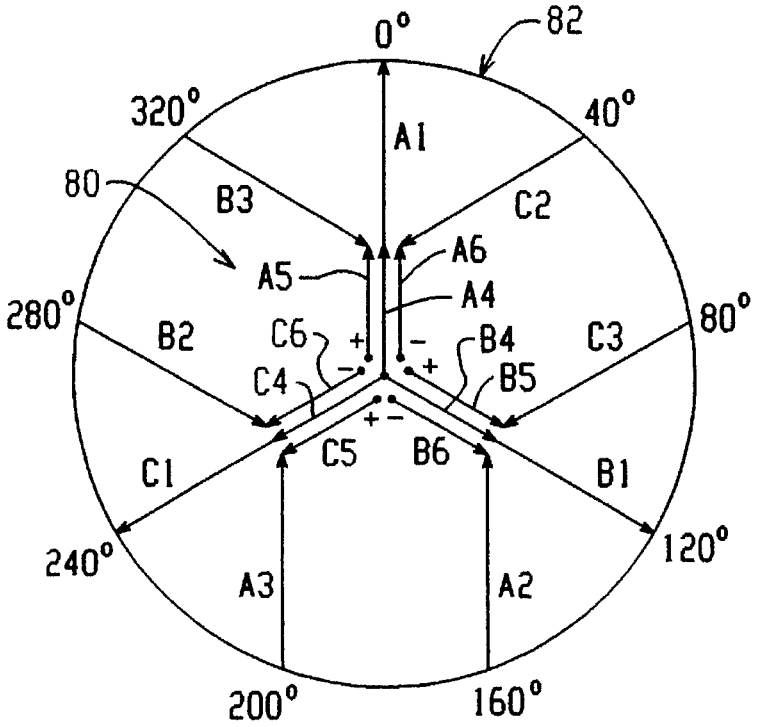
FIG. 5 is a secondary winding phase diagram for producing low harmonic currents.
Figure 9:
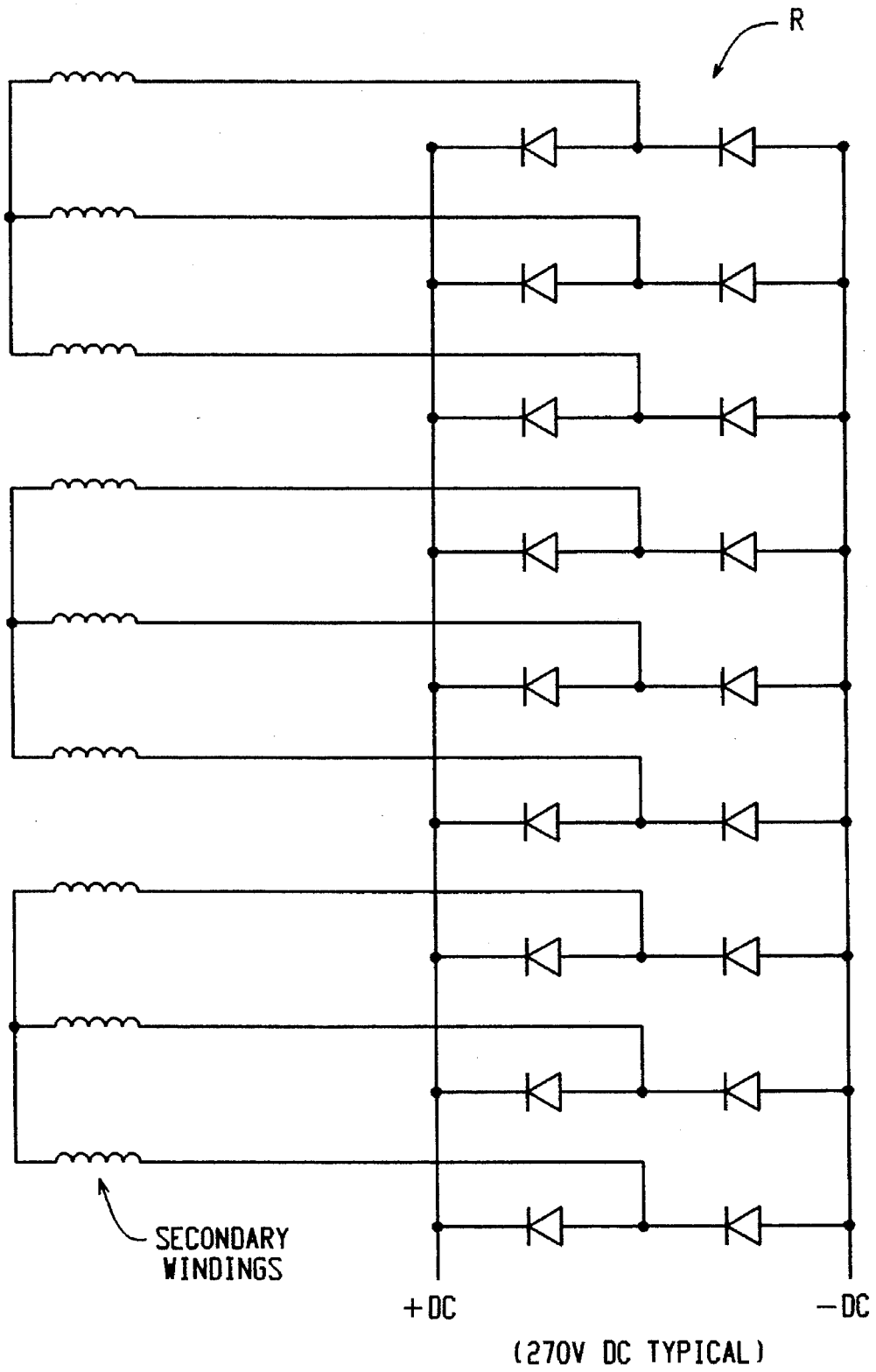
FIG. 9 is an electrical schematic of a DC rectifier circuit connected to the secondaries of a transformer in accordance with the invention.

Referring to FIG. 5, as previously described herein, the secondaries are grouped into three sets 80 comprising three output phases per set. Thus, each secondary output is 40 degrees phase shifted from two other secondary outputs so that the 9 phase outputs provide a total 360 degrees. We have found that when the secondaries are connected as illustrated in FIG. 5, there is a substantial reduction in the harmonic currents, yet only 9 output phases comprising a total of only 18 secondary windings is required. For a DC load, the 9 secondary outputs can be connected to a full wave bridge rectifier using only 18 diodes, whereas prior known conventional systems require at least 24 diodes. FIG. 9 shows such an arrangement for connecting a full bridge rectifier R to the secondary windings of the transformer 10.

Each secondary set 80 includes secondary main legs identified as A1, B1 and C1. The A, B and C letter designations are used for convenience to distinguish the three sets of secondary windings, with the numerals after the letters referring to a particular winding as identified in FIG. 5. For convenience only, the A group secondary main leg, A1, is considered to be the 0° phase angle output, however, this convention is arbitrary. Also for FIG. 5, the tail of a vector indicates the starting point of a winding and the arrowhead indicates the finish for the winding. Thus, for example, the mains A4, B4 and C4 all are connected together in a wye connection, and the phase shift between the A1 and B1 outputs is 120° (as well as between B1/C1 and C1/A1.) In addition to showing how the various windings are connected in phase relationship, the vectors in FIG. 5 also show that different windings have different ampere-turns in order that the precise 40° phase shift is achieved and that each secondary output is the correct voltage. In other words, the circle 82 represents the magnitude of the output voltage, so that each vector should closely start and finish as shown in FIG. 5 in order to achieve low harmonic currents; with the respective vector lengths being proportional to the number of turns for each corresponding winding.

Each secondary set includes the main legs (A1, B1, C1) as well as two auxiliary windings. For example, the A set includes auxiliary windings A2 and A3. The auxiliary windings, of course, are wound about the same vertex of the core 12 and thus carry currents in the same phase as the A1 winding. Thus, vectorially the A1, A2 and A3 vectors are all parallel to each other. A similar arrangement is provided for the B and C secondary sets.

Each secondary set further includes three additional main windings, which for the A set are designated A4, A5 and A6. The start of the A1 winding leg is connected to the finish of the A4 main winding, however, the A1 winding is physically disposed between the A4,A5,A6 windings and the A2,A3 windings (as at 62 in FIG. 4.) The windings A4,A5,A6 are also wound about the same vertex as the main leg A1 and the auxiliary windings A2 and A3. Preferably, the mains A5 and A6 are wound three in hand (trifiler) with the main leg A4 (as at 60 in FIG. 4), and the auxiliary windings A2 and A3 are wound two in hand (as at 66 in FIG. 4.) In FIG. 4, at 60, the mains A5, A6 are shown as being of larger cross-sectional area than A4 (relative proportions are exaggerated for clarity). This arises from the preferred arrangement of closely matching overall resistances between output terminal pairs. Since the A1 winding has less turns, A4 has a smaller cross-sectional area than the A5, A6 windings. The same holds for the B and C sets. Again, the length of each winding will be determined by the leakage inductance for the winding with primaries shorted and the desired voltage output/phase angle for that winding. The B and C secondary sets similarly include mains B4,B5,B6 and C4,C5,C6 connected and wound in a similar fashion.

According to the invention, the mains for each set are wye connected together similar to the wye connection of the main legs A4, B4 and C4. Thus, the starts of the mains A5, B5 and C5 are connected together in a wye connection; and the starts of the mains A6, B6 and C6 are wye connected. However, these three sets of wye connected secondaries are electrically isolated from each other. In other words, there is no electrical connection between the A4-B4-C4 set and the A5-B5-C5 set and the A6-B6-C6 set.

In addition to the three individual wye connected sets of mains, the auxiliary windings are connected in a particular manner. As shown in FIG. 5, the auxiliary windings are connected in a zig-zag arrangement to produce the desired 40° phase shift at each secondary output. For example, the start of auxiliary winding C2 is used as an output, and the C2 winding finish is connected to the finish of the A6 main. Furthermore, the start of auxiliary winding A2 is an output and the finish is connected to the finish of the B6 main. Thus, the A6-B6-C6 set of mains are included in a secondary set that produces a three phase output at the starts of the C2, A2 and B2 windings (wherein the C2/A2 output is produced by the C2-A6-B6-A2 windings and the C2/B2 output is produced by the C2-A6-C6-B2 windings and the A2/B2 output is produced by the A2-B6-C6-B2 windings.) These outputs are 120° phase shifted from each other of course, but the phases of the set is effectively rotated 40° from the A1-B1-C1 set. Similarly, the third secondary set A5-B5-C5 includes the zig-zag configurations of the windings B3-A5-B5-C3, the windings C3-B5-C5-A3 and the windings A3-C5-A5-B3.

As noted, the 0°/120°/240° circuit is electrically isolated from the 40°/160°/280° circuit from the 80°/200°/320° circuit. Also, the DC resistance from 0° to 120° to 240° should be equal to the corresponding resistances between the other output phases, namely 40°/160°/280° and 80°/200°/320°. For example, since A1 and B1 have fewer turns than C2, A6, B6 and A2, the A1 and B1 windings should be wound with a wire of smaller cross-sectional area which will give the A1/B 1 combination winding a resistance to match closely the C2-A6-B6-A2 combination.

The particular winding arrangement shown in FIG. 5, in combination with the double cut triangular core design and sandwiched secondaries provides a transformer performance with substantially reduced harmonic currents, in a transformer that is weight and cost competitive with alternative low harmonic approaches.

According to another aspect of the invention, the core 12 design allows for the input leads to the primary coils to be routed into the transformer from a side opposite the side used to route the output leads from the secondary windings to improve shielding and reduce coupling between the leads. The primary shields can also be brought out with their respective leads on opposite transformer sides for external connections as desired. The triangular core with mitered sides also provides the same iron leg area and coil space as a conventional three phase cut-C core (having three legs coextending from an end piece), but uses about 23% less volume. In other words, the double cut triangular core effectively increases the iron leg area in a smaller total volume package as compared to a conventional three phase cut-C core.

Figure 6:
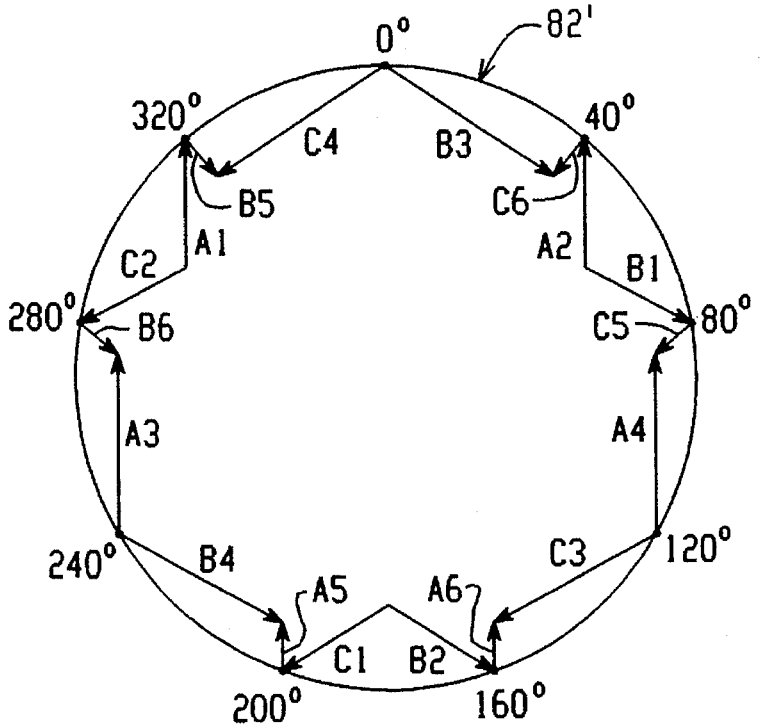
FIG. 6 s a secondary wiring phase diagram for an alternative winding arrangement.

With reference now to FIG. 6, an alternative secondary winding configuration can be used that also results in low harmonic currents, although not quite as low as the arrangement in FIG. 5. This configuration is a nonagon or ring configuration. The secondary windings are all series connected as shown, as compared with the embodiment of FIG. 5 wherein there were three electrically isolated sets of secondaries. In FIG. 6, as in FIG. 5, the phase related sets are identified with the letters A, B and C and are connected in the manner shown. Again, winding turns and resistances (wire gauge) are selected as needed to achieve the desired output voltages and phase relationships across the secondary outputs. The associated windings are disposed about the respective vertices of the core 12.

Figure 7:
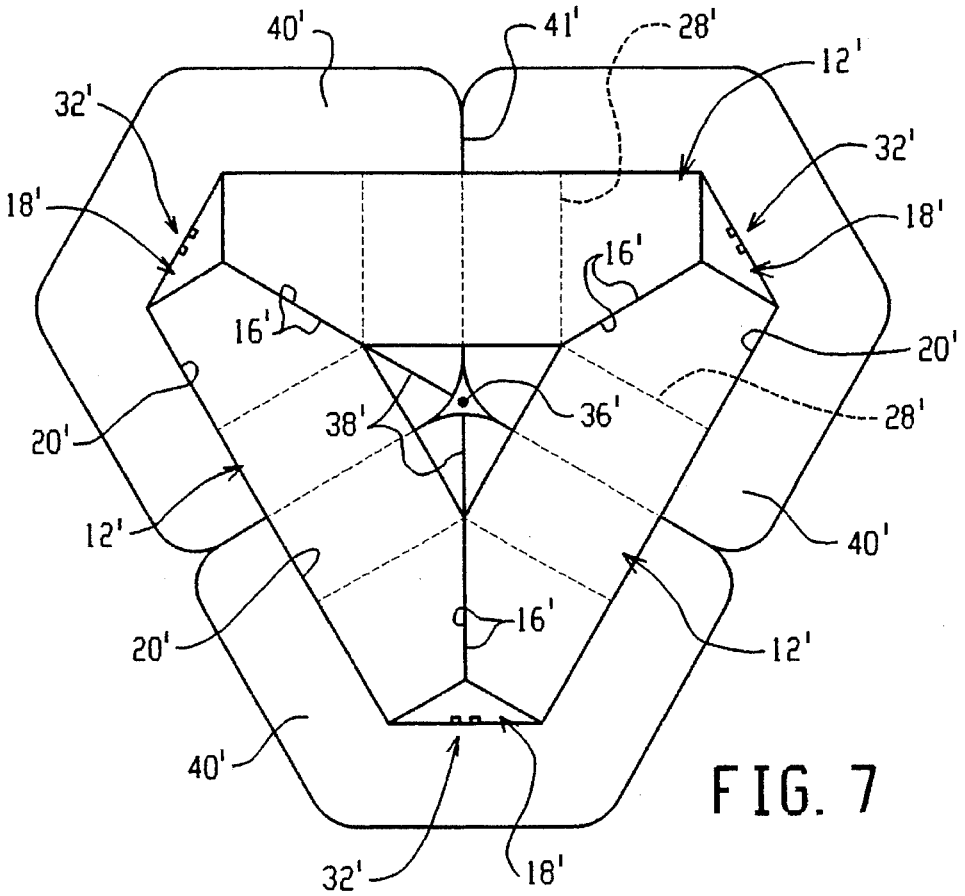
FIG. 7 is a top view of an alternative embodiment for the transformer core using a single cut design.

With reference next to FIG. 7, we show an alternative design for the triangular core 12' (with the bobbin flanges omitted for clarity.) In this design, each core assembly 12' is beveled only on one side 14' thereof, that being the side that is placed in contact with the adjoining core assembly at each vertex 18'. This single cut design, of course, reduces the steps needed to form the core sections, but the bobbins 20' have more sharply defined corners. Thus, as compared to the embodiment of FIG. 1, the transformer core of FIG. 7 has somewhat sharper corners in the windings and bobbin near the vertices and thus has less of a cylindrical envelope. However, this embodiment still can conveniently be used in a cylindrical housing or polygon housing.

Figure 8:
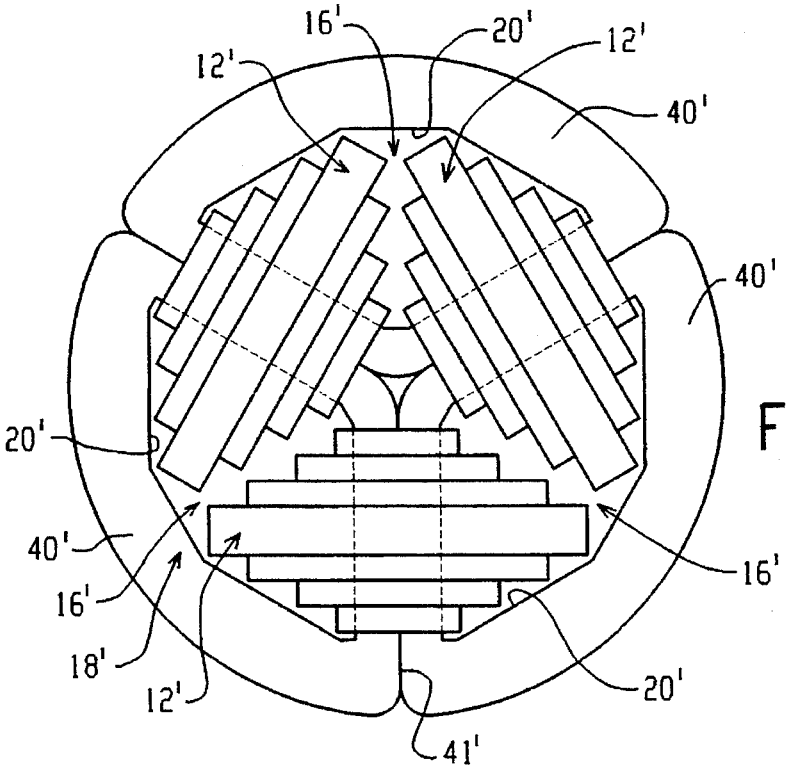
FIG. 8 is a top view of a transformer using an alternative core construction in accordance with the invention.

With reference now to FIG. 8, we show still another embodiment of the core assemblies 12'. In this embodiment, each core assembly 12' is built up in a cruciform configuration (preferably using square yokes) in such a manner as to achieve in effect the mitered sides 16'. The sides 16' could also be shaped by cutting or other convenient means is desired to achieve a smoother interface at the vertices. The cruciform contour, of course, is achieved by lamination windings that progressively narrow. The step-wise effect that results can be minimized as required to achieve adequate magnetic coupling between adjacent core sections (in FIG. 8 the step-wise effect is exaggerated for clarity and ease of explanation).

Those skilled in the art will readily appreciate that the specific cut-C core outlines described and shown herein can be modified as desired. For example, the core bodies can be round, square, rectangular and so forth while still achieving the basic triangular configuration with three vertices. The cores can also be molded from powdered iron as distinguished from using built up laminated cores. Furthermore, the secondary winding arrangements according to the invention can be used with triangularly arranged cores, or conventional cores with or without mitered edges. These are but a few of the many modifications possible that will be apparent to those skilled in the art within the teachings of the present invention.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

I claim:

1. A transformer comprising a core, a plurality of primary coils and a plurality of secondary coils, said core having three sections arranged in a generally triangular configuration forming three vertices, said coils being disposed on said core about respective vertices, each of said core sections having a leg with at least one smoothly mitered side abutting a smoothly mitered side of an adjacent section.

2. The transformer according to claim 1 wherein each core section comprises a pair of cut-C cores.

3. The transformer according to claim 2 wherein each section has single cut mitered sides to reduce air gaps between the core and coils and increase core uniformity at each of said vertices.

4. The transformer according to claim 2 wherein each section has double cut mitered sides symmetrical about a center axis thereof to reduce air gaps between the core and coils and increase core uniformity at each of said vertices.

5. The transformer according to claim 2 wherein each cut-C core comprises two generally parallel legs coextending from opposite sides of an end piece.

6. The transformer according to claim 5 wherein sides of said end pieces are cut at an angle so that said vertices are formed by core sides that flushly abut each other.

7. The transformer according to claim 6 wherein each of said core sections has a side cut at 60 degrees so that said core when assembled is generally in the shape of an isosceles triangle.

8. The transformer according to claim 1 wherein each primary coil comprises two electrically connected multiturn windings with respective secondary coils disposed between said primary windings.

9. The transformer according to claim 8 wherein an inner primary winding is disposed about a first vertex, respective secondary coils are disposed about said inner primary winding, and an outer primary winding is disposed about said first vertex.

10. The transformer according to claim 9 wherein said inner primary-secondary-outer primary arrangement is provided at each vertex of said core.

11. The transformer according to claim 1 wherein said primary coils are wound on bobbins that slidably receive respective core section legs.

12. The transformer according to claim 11 further comprising insulated shield layers disposed between adjacent primary/secondary coil interfaces.

13. The transformer according to claim 12 wherein said shield layers comprise multiple copper laminated insulation layers.

14. The transformer according to claim 11 wherein each bobbin is a trapezoidal split assembly disposed about a respective vertex of the transformer; wherein each bobbin is split in a radial direction with respect to its vertex so that associated bobbin halves can slidably receive respective core section legs that form each respective vertex.

15. The transformer according to claim 1 wherein the transformer comprises a three phase input to nine phase output converter having three primary coils and nine secondary coils, said secondary coils being connected as three sets comprising three windings each, each of said secondary sets being electrically isolated from each other and wherein each of said nine secondary outputs is forty degrees phase shifted from other secondaries.

16. The transformer according to claim 15 wherein said secondary coil sets each comprise three wye-connected mains.

17. The transformer according to claim 16 wherein at least one of said secondary coil sets further comprises auxiliary windings connected zig-zag between a respective main of one phase and an input of a different phase.

18. The transformer according to claim 17 wherein said secondaries are connected to rectifier means for producing a transformer DC output with low harmonic primary currents of less than 1%.

19. A transformer core comprising three cut-C cores arranged in a triangular shape forming three vertices, each pair of adjacent cores at a vertex having complementary smoothly beveled legs.

20. The transformer core according to claim 19 wherein each cut-C core includes a single-cut mitered side so that said vertices are formed with flushly abutting faces between core legs.

21. The transformer core according to claim 20 wherein said cores are laminated structures.

22. The transformer core according to claim 19 wherein each cut-C core includes double cut mitered sides to increase bobbin fill and reduce air gaps at said vertices when coils are wound on bobbins and disposed on said cores about said vertices.

23. A coil arrangement for a low harmonic transformer connectable to a three phase input comprising three primary coils and nine secondary coils disposed on a core having three sections, each primary coil being magnetically linked to at least two of said core sections said secondary coils being arranged in three sets of three coils, each of said three sets being wye connected and electrically isolated from each other.

24. The coil arrangement according to claim 23 wherein at least one of said secondary sets includes three mains wye connected and two auxiliary windings, each auxiliary winding being zig-zag connected between a main of one phase and connectable as an output of another phase.

25. The coil arrangement according to claim 24 disposed on a mitered triangular transformer core to produce a nine phase output using only eighteen secondary windings.

26. The coil arrangement according to claim 25 wherein each primary coil comprises two windings electrically connected with a first of said primary windings disposed on the core, associated secondary windings disposed about said first primary winding, and a second of said primary windings disposed about said associated secondary windings.

27. The coil arrangement according to claim 26 wherein coil resistance between associated output terminals for each secondary phase output is substantially equal for all said secondary coils.

28. A method for assembling a transformer comprising the steps of:

a. arranging three cores in a generally triangular configuration forming three vertices when said cores are inserted into prewound coils;

b. disposing a primary coil about each vertex;

c. disposing one or more secondary coils respectively about an associated primary coil; and d. disposing three additional primary coils, each respectively and electrically connected to the other primary coil on the same vertex, about each vertex on top of said respective secondary coils, wherein said coils are wound into the desired configuration, then said cores are inserted into said windings.

29. The method of claim 28 wherein said coils are wound on bobbins preshaped to the desired coil configuration prior to insertion of said cores.

30. The method of claim 28 wherein the step of arranging three cores includes a step of forming each core from cut-C cores and bevelling at least one side of each core to form mitered comers at said vertices.

* * * * *